United States Patent [19]

Carney

[11] 4,302,184

[45] Nov. 24, 1981

[54] METHOD AND DEVICE FOR ANIMAL TOOTH RESTORATION

[76] Inventor: Henry J. Carney, Star Rte. #1, Hatchett Ranch, Baird, Tex. 79504

[21] Appl. No.: 175,854

[22] Filed: Aug. 6, 1980

[51] Int. Cl.[3] ..... A61D 5/00

[52] U.S. Cl. ..... 433/1

[58] Field of Search ..... 433/39, 158, 159, 157, 433/156, 155, 153, 154, 136, 137, 1

[56] References Cited

U.S. PATENT DOCUMENTS

| | | | |
|---|---|---|---|
| 1,572,901 | 2/1926 | Miller | 433/154 |
| 3,140,543 | 7/1964 | Menter | 433/1 |
| 3,868,513 | 2/1975 | Gonser | 433/228 |

FOREIGN PATENT DOCUMENTS

| | | | |
|---|---|---|---|
| 14914 | of 1893 | United Kingdom | 433/1 |

*Primary Examiner*—Robert Peshock

*Attorney, Agent, or Firm*—Harvey B. Jacobson

[57] ABSTRACT

The device is a matrix comprising a pair of metal bands interconnected to form an elongated, adjustable loop to fit over the lower teeth of an animal. A clamp device is attached to the bands for engagement with the animal's chin. The method includes holding the animal's mouth open, inserting the matrix and filling the matrix with a putty-like substance which is allowed to harden forming one continuous denture over the animal's worn teeth.

7 Claims, 17 Drawing Figures

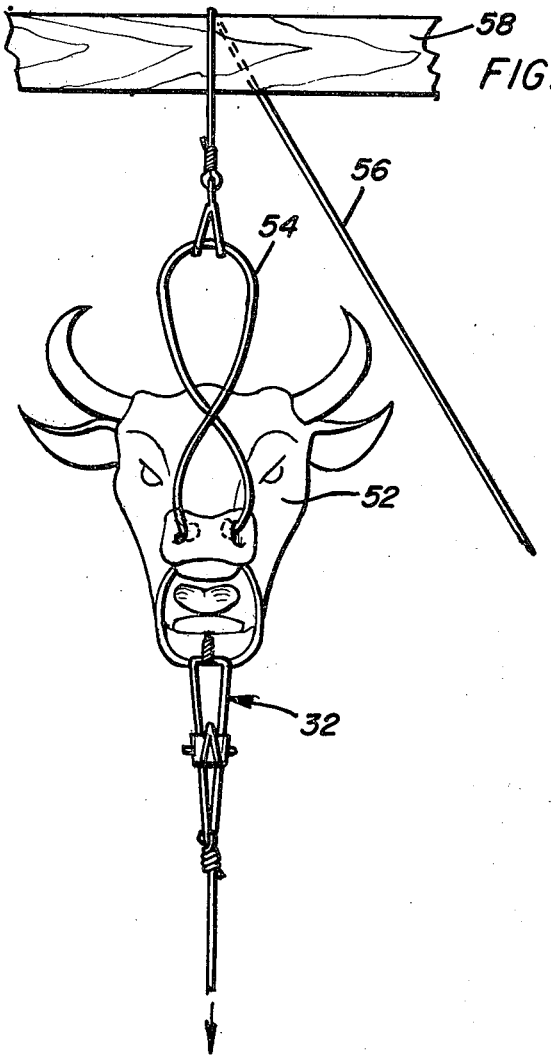
FIG. 7
FIG. 8
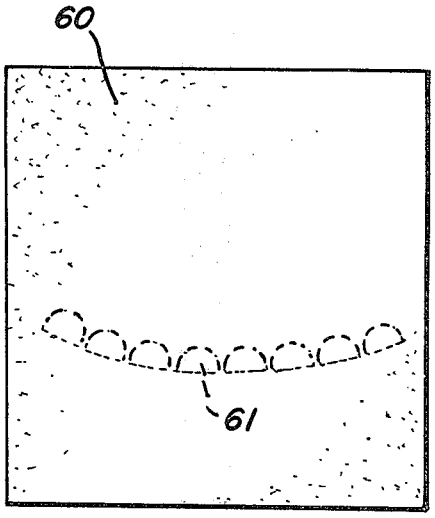
FIG. 10
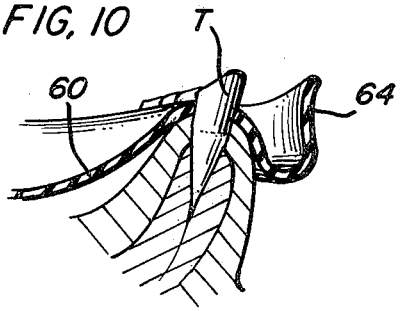
FIG. 9
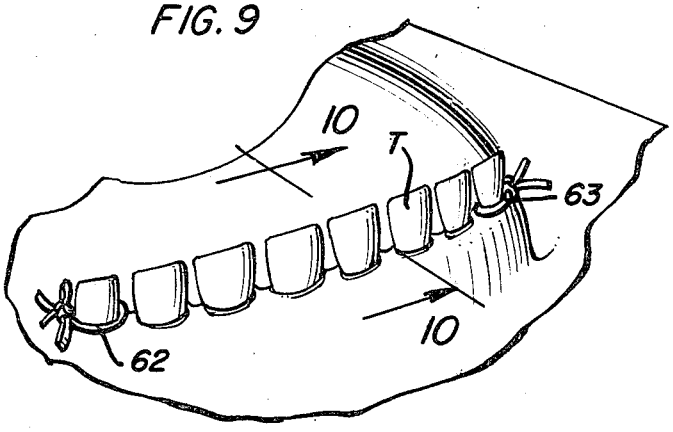
FIG. 11
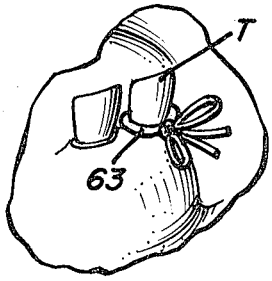

METHOD AND DEVICE FOR ANIMAL TOOTH RESTORATION

BACKGROUND OF THE INVENTION

1. Field of the Invention

This invention relates to the reconstruction of the teeth of grazing animals.

2. Discussion of Related Art

Animals wear down their natural teeth in areas where ranches are over-stocked or where the grassland is of poor quality or is spread with sand by high winds. When the animals cannot eat sufficient grass, their health is impaired and they die before reaching their most productive and profitable age. Accordingly, some method of restoring the teeth of these animals in a simple, efficient manner would be desirable. However, no method exists for performing this task.

Various dental instruments which are held within a patient's mouth are known. U.S. Pat. No. 3,992,781, issued Nov. 23, 1976, to Sturdivant, shows a cotton roll holder having arcuately shaped elements to fit adjacent the patient's gum and a chin plate mounted on a support post for holding the arcuate elements against the base of a patient's mouth. A similar device is shown in U.S. Pat. No. 3,805,389, issued Apr. 23, 1974, to Sturdivant. U.S. Pat. No. 1,604,136, issued Oct. 26, 1926, to Stoloff, shows a rubber dam construction for dental use which comprises a rubber sheet having a plurality of nipple-shaped protuberances to cooperate with individual teeth.

SUMMARY OF THE INVENTION

One object of the present invention is to provide a device and method by which the worn down teeth of grazing animals can be easily and effectively covered with a denture in order to prolong the animal's life.

A further object of the present invention is to provide a device and method for animal tooth restoration which method can be performed easily by the animal owner.

An even still further object of the present invention is to provide a device and method for animal tooth restoration wherein the device is relatively simple and inexpensive to construct in order that it can be available for use by large numbers of animal owners and further wherein the other implements used in the method are standardly available tools or dental instruments.

In accordance with the above objects, the device of the present invention comprises a matrix formed of two bands of metal bent and slidably joined in an elongated loop configuration. A screw fastener holds the two bands in a predetermined position while a support post depends from the bands and slidably mounts a chin plate for providing pressure against the animal's chin to hold the bands about the teeth to be restored.

The method comprises the steps of holding the animal's mouth in an open position by use of a pair of tongs. A rubber dam is then disposed over the teeth to be restored and the matrix is adjusted to fit around the teeth and is held in place by the chin plate. A putty-like substance is then applied to the teeth and the matrix is overfilled with the material. The animal is then allowed to bite and any excess putty-like substance is removed. The material is then cured and the matrix removed to provide a continuous length of denture with which the animal can once again graze.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 7 is an elevational view showing the tongs as used in the first step of the method.

FIG. 8 is a view showing the rubber dam used in the method of the present invention.

FIG. 9 is a perspective view showing the rubber dam in position on the animal's teeth.

FIG. 10 is an elevational sectional view taken substantially along a plane passing through section line 10—10 of FIG. 9.

FIG. 11 is a part fragmental view showing the use of dental floss to hold the dam in place.

DETAILED DESCRIPTION OF THE DEVICE AND METHOD FOR ANIMAL TOOTH RESTORATION

Figure 1:
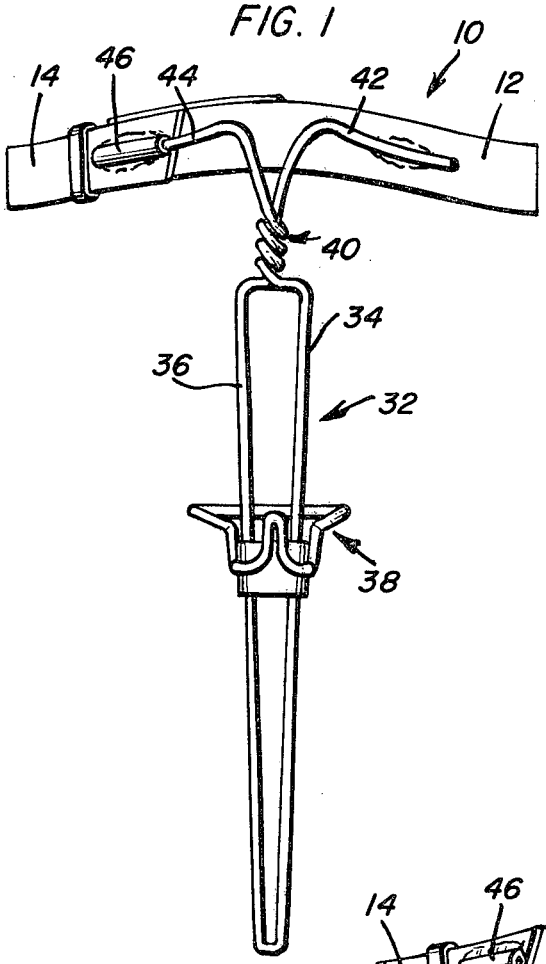
FIG. 1 is a front elevational view of the matrix of the present invention.
Figure 2:
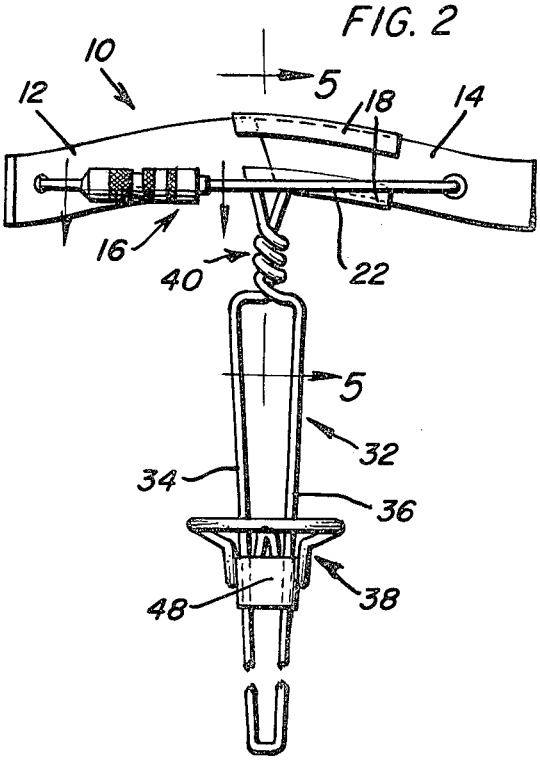
FIG. 2 is a rear elevational view of the matrix.
Figure 4:
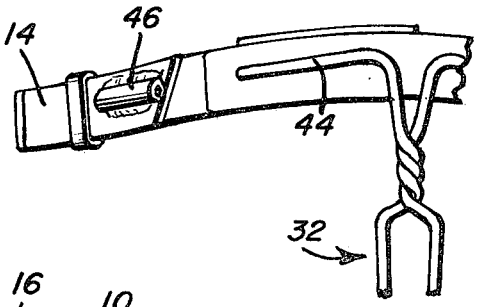
FIG. 4 is a detailed view of the matrix showing the connection of the support post to one of the matrix bands.
Figure 6:
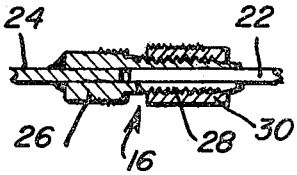
FIG. 6 is a top plane sectional view taken substantially along a plane passing through section line 6—6 of FIG. 2.
Figure 3:
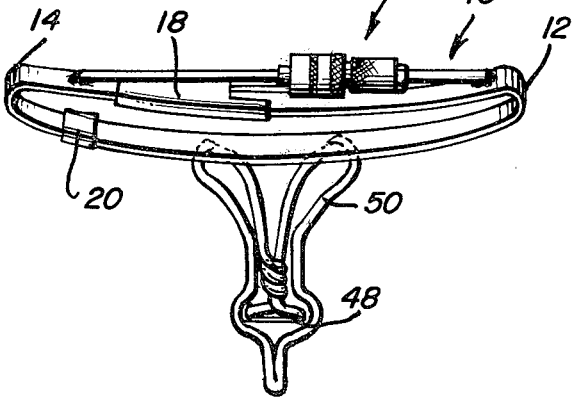
FIG. 3 is a top plan view of the matrix.
Figure 5:
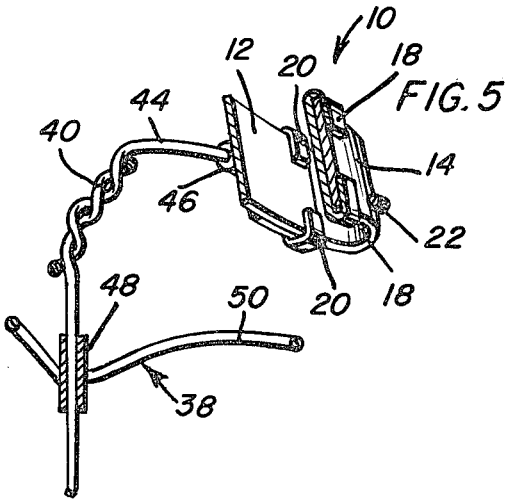
FIG. 5 is an elevational sectional view taken substantially along a plane passing through section line 5—5 of FIG. 2.

With reference to FIGS. 1 through 6 of the drawings, the matrix device of the present invention generally referred to by the reference numeral 10 will be seen to include a pair of metal bands 12 and 14 each of which is bent into an elongated U-shape and longitudinally curved to conform to the base of the animal's mouth upon which it is to be used. The bands are slidably interconnected and held in position by a locking device 16. One end of band 12 is folded over at flaps 18 to receive a free end of band 14 slidably therein. In like manner, flaps 20 are folded over band 14 to receive the opposite end of band 12 slidably therein. Accordingly, the bands 12 and 14 can be slid with respect to one another to adjust the area within the loop formed by the bands. The locking device 16 holds the bands in the desired mutual orientation achieved. The locking devide 16 includes a bar 22 which is fixed to and extends alongside of band 14. A second bar 24 is attached to band 12 in alignment with bar 22. Bar 24 mounts a chuck 26 which receives the free end of bar 22. The end of chuck 26 shown at 28 is threaded and receives nut 30 which forces the chuck end 28 into engagement with the bar 22 to hold the bar securely in the chuck. In this manner, the longitudinal extent of the matrix can be adjusted or the two bands 12 and 14 can be completely separated by sliding them completely apart and removing bar 22 from the chuck completely.

The bands 12, 14 and locking device 16 are preferably formed from copper, stainless steel, or any other suitable material, and can be sized appropriately to fit the needs of the user. In actual operation, the loop formed by bands 12 and 14 was made to have a minimum extent of approximately 3½" and a maximum extent of approximately 3¾". Of course, any other dimension suited to the user would work as well.

In order to hold the fixed bands 12 and 14 in the mouth of the animal being worked on, a support structure in the form of support frame 32 is connected to the bands 12 and 14. Support frame 32 includes laterally spaced wires 34 and 36 which mount chin brace 38. Wires 34 and 36 are twisted at 40 and separate to form divergent ends 42 and 44. End 42 is fixedly attached to band 12 while the end 44 is slidably received in sleeve 46 which is mounted on band 14. Accordingly, when band 14 and band 12 are separated by disconnection of the locking device 16, the end 44 of frame 32 is removed from sleeve 46 and band 14 is free to be completely separated. When the bands are connected and end 44 is received in sleeve 46, downward force provided by chin brace 38 is transmitted to the extreme ends of the bands to insure a good fit in the mouth of the animal whose teeth are being restored. It will also be noted that the twisted portion 40 is bent away from wires 34 and 36 while ends 44 and 42 are bent slightly downward and laterally away from twisted portion 40 on both sides. This allows space for the gum and lower lip of the animal when the device is used.

Figure 13:
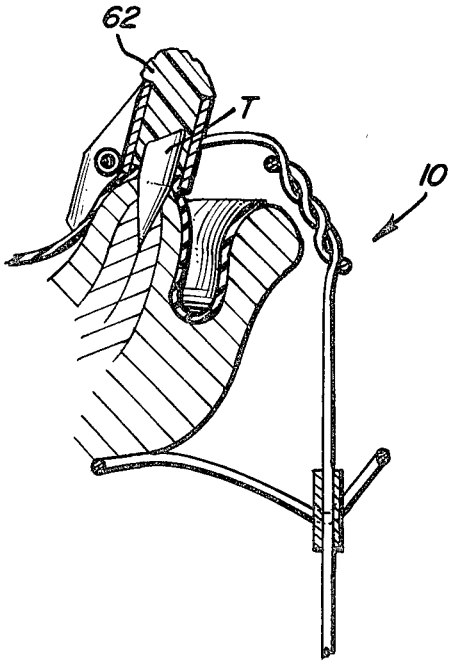
FIG. 13 is a sectional view showing the matrix filled with denture material.
Figure 14:
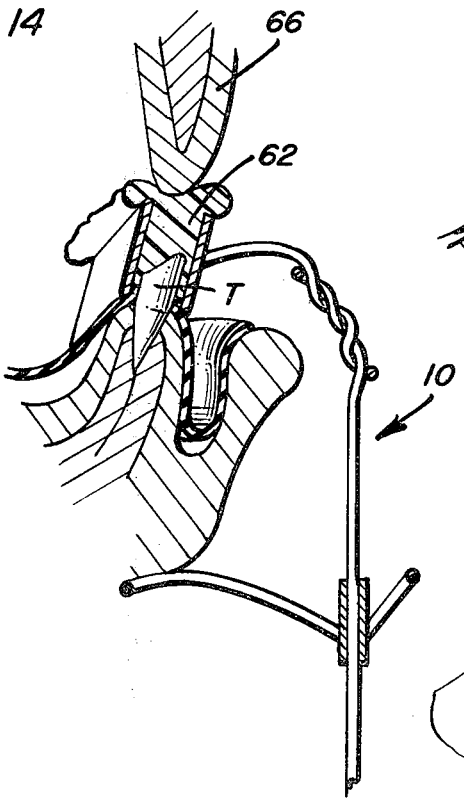
FIG. 14 is a sectional view showing the biting surface of a matrix being formed.

Chin brace 38 comprises a sleeve 48 which rides on the wires 34 and 36. Sleeve 48 is designed to fit snugly on the wires 34 and 36 forcing those wires slightly together in order that the sleeve will be maintained by friction at any vertical position at which it is placed on the wires. A wire hoop 50 encompasses the sleeve 48 and is elongated in the direction of the bend of twisted portion 40. Accordingly, it can easily be seen that with the bands 12, 14 disposed over the teeth of an animal, the twisted portion 40 extends out of the animal's mouth and the chin brace 38 can be pushed beneath the chin of the animal into contact therewith for holding the wire bands down on the animal's teeth while the method of the invention is performed, as shown in FIGS. 12–14.

Now with reference to FIGS. 7 through 17, the method of use of the matrix 10 will be described in detail. First, with reference to FIG. 7, it can be seen that after the animal 52 is placed in a chute to hold the animal relatively still, the animal's mouth is opened by the use of leader or tongs 54. The pincers of leader 54 are place in the nostrils of the animal and a rope 56 is tied to the leader and swung over a convenient brace 58. The animal's head is pulled upwardly thereby opening the animal's mouth. By controlling the tension of the rope 56, the disposition of the animal's head can easily be controlled.

With the mouth of the animal opened and steadied, the teeth are washed and dried with a clean cloth. A dam 60 as shown in FIG. 8 is placed over the animal's teeth. The dam is a standardly available item comprising an elasticized sheet of rubber and is available at any dental house or veterinary store. Teeth markings 61 are made in the dam 60 by contact with the teeth and the holes are punched through the markings 61 to allow the dam to fit snugly over the lower eight teeth down to the gumline as shown in FIG. 10. This isolates any irritation which may be caused to the gum by the procedure. The dam is held in place about each tooth by the elasticity of the rubber. If the dam appears to be slipping, a small piece of dental floss shown at 63 in FIGS. 9 and 11 can be tied about each end tooth to hold the dam in place. The dam is folded upwardly as shown at 64 in FIG. 10 at the gum line in order to prevent irritation of the gum and to strengthen the edge of the applicane.

Figure 12:
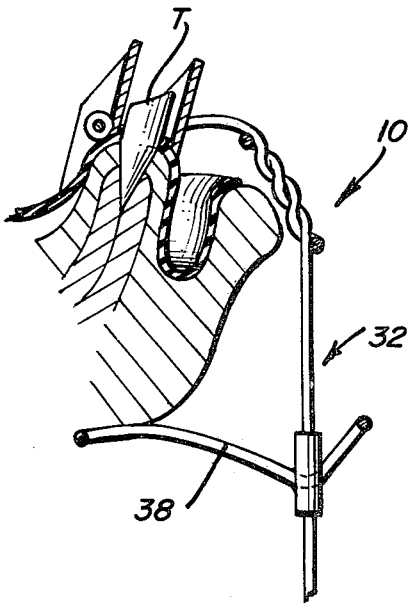
FIG. 12 is a sectional view showing the positioning of the matrix about the animal's teeth.

The entire matrix device 10 is then fitted over the teeth T of the animal as shown in FIG. 12. About 1/16" margin is left on all sides of the teeth and chin brace 38 is then slid upwardly on the frame 32 of the matrix 10 in order to hold the bands firmly over the teeth T.

A putty-like substance sold under the trade name "Wright's Rite" is then used to fill the area within bands 12 and 14. The putty-like substance, shown at 62 in FIG. 13, is squeezed between the teeth of the animal using the fingers and thumb. The material is also squeezed between the teeth and the inner surfaces of bands 12 and 14 and care must be taken that the teeth T are maintained in the middle of the bands. The matrix should be filled to overflowing as shown in FIG. 13.

Figure 15:
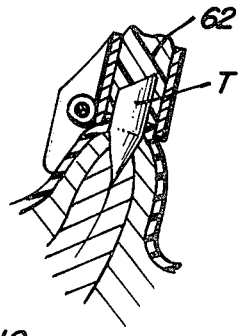
FIG. 15 is a sectional view showing the completed denture with the matrix still in place.
Figure 16:
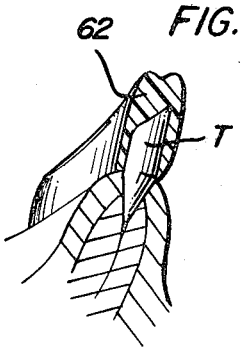
FIG. 16 is a sectional view showing the completed denture.
Figure 17:
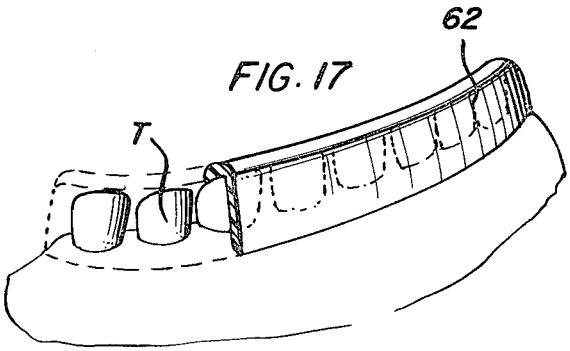
FIG. 17 is a perspective, part fragmental view, showing the completed denture.

Next, as shown in FIG. 14, the rope 56 is released slightly with the animal maintained under control by slight tension on the rope. The animal is allowed to begin a biting motion by bringing his upper pad or gum 66 into contact with the putty substance 62 in order to create a bite in the substance 62. The rope 56 is then again pulled taut to open the animal's mouth. The excess overflowing the edges of the matrix is then trimmed away so that the substance 62 appears neatly within the confines of the matrix as shown in FIG. 15.

At this point the substance 62 is cured. Curing can be effected through the use of an ultraviolet light which is held within the animal's mouth for a period of two or three minutes. Once the material 62 is cured to form hardened denture, the matrix 10 can be removed by loosening the nut 30 of locking device 16 and separating the bands 12 and 14 completely. The matrix 10 is then completely removed from the animal's mouth leaving the teeth T completely covered with the putty material 62 forming the denture as clearly shown in FIG. 17. The denture should be checked for rough and sharp surfaces prior to releasinng rope 56 and allowing the animal to roam freely.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A matrix device for use in restoring the worn teeth of grazing animals, comprising:

a band member formed into a loop;

adjustment means attached to said band member for adjusting the effective length of said band member;

support frame means connected to said band member for supporting said band member from a position remote therefrom;

means disposed on said frame means and slidable therealong for engaging the external surface of an animal's mouth for holding said band member in position about an animal's teeth, band member comprising two separate bands, each of said separate bands being generally U-shaped in configuration with each of said U-shaped bands being curved longitudinally to conform to the gum of an animal whose teeth are to be restored, said adjustment means including a chuck attached to one of said bands, a rod attached to the other of said bands, said rod being insertable in said chuck and movable in relation thereto, and means for tightening said chuck about said rod to lock the rod and separate bands in adjusted relation.

2. The invention as defined in claim 1 wherein said support frame means includes a pair of laterally spaced resilient frame members, and wherein said means slidable on the frame means includes a sleeve disposed over said resilient frame members and slidable along said frame members, said sleeve being mounted on said frame members so as to urge said frame members together thereby producing a friction mounting of said sleeve on said members.

3. The invention as defined in claim 2 wherein said support frame means further includes a pair of diverging frame ends, one of said ends being fixedly attached to one of said U-shaped bands, the other of said frame ends being slidably attached to the other of said U-shaped bands.

4. A device for restoring the occlusal surface of a plurality of animal teeth coomprising an elongated band forming a closed loop for encircling the plurality of teeth on which the occlusal surface is to be restored, the lower edge of the band adapted to be disposed adjacent the gum area and the top edge of the band adapted to extend above the occlusal surface of the teeth, the elongated inner and outer portions of the band being longitudinally curved and adapted to be disposed adjacent the inner and outer surfaces of the teeth, means attached to the outer portion of the band and extending outwardly and downwardly therefrom, chin engaging means adjustably mounted on said outwardly and downwardly extending means adapted to engage the undersurface of the chin to removably retain the band in position, said band including means enabling variation in the longitudinal length of the inner and outer portions thereof to enable variation in the over-all length of the closed loop to adjustably fit around the teeth, the top of the band being open to receive a hardenable denture material for restoring the occlusal surface of the teeth.

5. The device is defined in claim 4 wherein said outwardly and downwardly extending member includes a frame member, said chin engaging means including sleeve means slidable on the frame member, and a chin engaging member mounted on said sleeve.

6. The device as defined in claim 4 wherein said band includes a pair of substantially U-shaped members, said means enabling variation in length of the inner and outer portions including an overlapping telescopic relationship of the leg portions of the U-shaped members, and means interconnecting the overlapping leg portions forming one of the portions of the band to enable adjustment of the U-shaped members toward and away from each other and locking the U-shaped members in adjusted position.

7. The device as defined in claim 6 wherein said adjustment and locking means is on the inner portion of the band and disposed on the surface thereof remote from the teeth to enable manipulation of the adjustment and locking means after the denture material has hardened to enable removal of the device.

* * * * *